United States Patent [19]

Mertz

[11] 4,046,571

[45] Sept. 6, 1977

[54] PROCESSING SOLUTION FOR USE AS PHOTOGRAPHIC DEVELOPER BATH AND REPLENISHER THEREFOR

[75] Inventor: John R. Mertz, Conklin, N.Y.

[73] Assignee: GAF Corporation, New York, N.Y.

[21] Appl. No.: 591,093

[22] Filed: June 27, 1975

[51] Int. Cl.[2] ..... G03C 5/26; G03C 5/30

[52] U.S. Cl. ..... 96/66 HD; 96/50 A; 96/50 R; 96/66.5; 96/66.3

[58] Field of Search ..... 96/66, 66.3, 66.4, 66.5, 96/50 R, 63, 50 A, 66 HD

[56] References Cited

U.S. PATENT DOCUMENTS

| | | | |
|---|---|---|---|
| 3,353,957 | 11/1967 | Blake | 96/66.3 |
| 3,451,819 | 6/1969 | Haugh | 96/66.3 |
| 3,582,341 | 6/1971 | Kane | 96/66 HD |
| 3,869,289 | 3/1975 | Amering | 96/66.3 |
| 3,925,086 | 12/1975 | Baldassarri et al. | 96/66.5 |

FOREIGN PATENT DOCUMENTS

| | | | |
|---|---|---|---|
| 1,042,479 | 9/1966 | United Kingdom | 96/66 HD |

OTHER PUBLICATIONS

Photo Lab. Index, Copyright 1972, Morgan & Morgan Inc. pp. 3-204.022, 3-204.023.

Chem. Absts. vol. 68, 1968 25419k.

Ilford, Manual of Photography, 1971 pp. 393-405.

Mason, Photographic Processing Chemistry, 1966, pp. 136-155.

Langford, Basic Photography, 1965 p. 285.

Clerc, Photography: Theory & Practice, 1937 pp. 256-257.

*Primary Examiner*—Mary F. Kelley

*Attorney, Agent, or Firm*—Walter C. Kehm; Edward G. Comrie

[57] ABSTRACT

An aqueous photographic processing solution useful as a photographic developer bath and as a replenisher therefor, consisting essentially of, per liter:

| | |
|---|---|
| A 1-phenyl-3-pyrazolidone photographic developer | 0.8 to 1.8g |
| Hydroquinone or a derivative thereof | 15 to 35g |
| Bromide ion | 0 to 4g |
| Organic anti-foggant and film speed restrainer | 7 to 26 mmol |
| Alkaline material and buffer to provide a pH at 25° C of 10.0 + 0.8 − 0.5. | |

8 Claims, 1 Drawing Figure

SENSITOMETRY OF X-RAY FILM PROCESSED WITH PROCESSING SOLUTION OF THE PRESENT INVENTION AND WITH PRIOR ART SYSTEM.
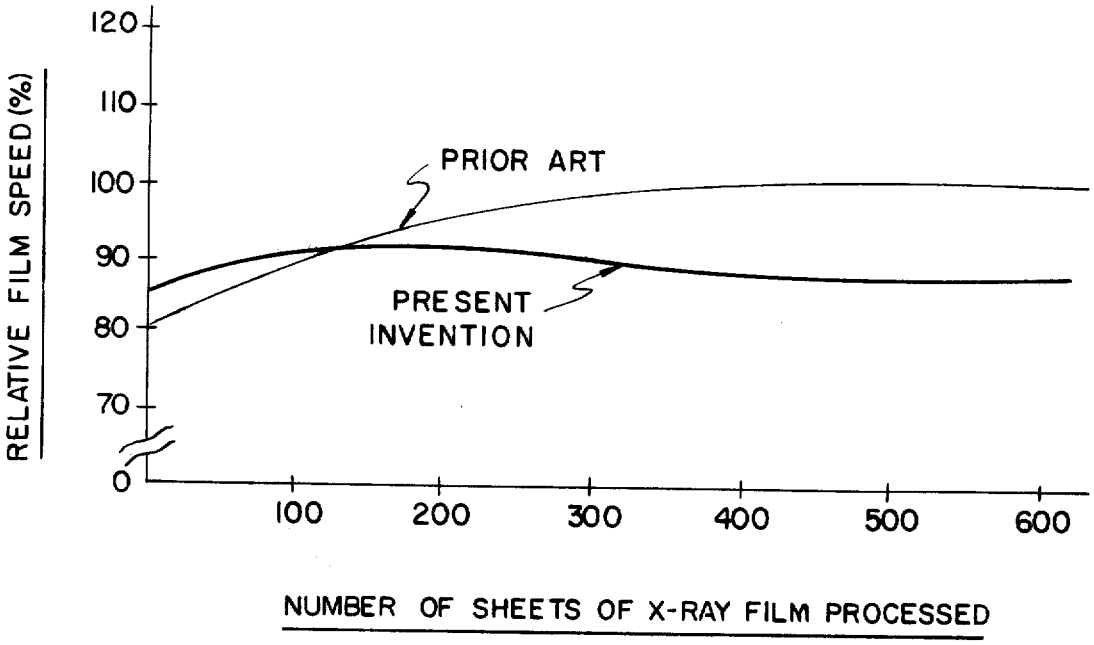

PROCESSING SOLUTION FOR USE AS PHOTOGRAPHIC DEVELOPER BATH AND REPLENISHER THEREFOR

This invention relates to photographic silver halide developer compositions, and more particularly to a novel developer solution that is also used as a replenisher solution.

Present practice in the development of silver halide photographic products, such as imagewise exposed X-ray film, in automatic processing equipment employs two processing solution, namely a "developer concentrate" and a "starter solution", from which are made the photographic developer bath and the "replenisher". Thus, the developer concentrate containing the photographic developer and other ingredients is mixed with water and the starter solution, which contains acid and bromide, to form the photographic developer bath. The developer concentrate is also used to form the replenisher by dilution thereof with water, the replenisher serving to provide photographic developer and other ingredients that have been consumed or removed from the bath during the development process. The replenisher thus serves the function of maintaining constant the photographic properties of the photographic developing bath during the processing of a large quantity of exposed silver halide material. In practice, the replenisher has differed from the photographic developer bath by having a higher pH and by being free, or essentially free, of bromide ions.

While the present system of developer concentrate, starter solution and replenisher are in wide use in automatic processing of exposed silver halide photographic material, nevertheless certain disadvantages are inherent, since most of the ingredients in the photographic developer bath equilibrate to a lower concentration than in the fresh developer, except for pH which generally remains constant and bromide which will equilibrate to a somewhat higher concentration. These disadvantages include:

1. Over- and under-replenishment of the photographic developer bath a. Over-replenishment will make the pH of the photographic developer bath drift toward the higher replenisher pH and the bromide concentration will go to a lower level. Also, if the photographic developer bath is already in its equilibrated state, its chemical concentrations will tend to drift to higher levels. The net result of these developer bath composition changes, from over-replenishment, produces an undesirable increase in developer bath activity leading to poor photographic quality of the processed films.

b. Under-replenishment will produce poor photographic quality due to insufficient amounts of developer, etc., and the only way to correct this is to increase the replenishment rate to its proper level.

2. Lack of storage stability of replenisher

Replenishers above a pH 10.00 are not very stable, having a shelf-life of about two weeks.

3. Photographic activity of the developer bath changes with use

During developer equilibration, the sensitometric changes which occur in the processed films are generally within acceptable limits, but a reduction in the amount of change is highly desirable.

There is thus a need for a developer/replenisher system that can avoid the deleterious effects of both over- and under-replenishment, that employs a replenisher of improved shelf-life and that provides more constant sensitometric characteristics during extended use.

It is thus an object of the present invention to provide an improved developer/replenisher system for development of exposed silver halide photographic materials.

It is another object of the present invention to provide such a developer/replenisher system that avoids the use of a starter solution.

These and other objects are accomplished by the present invention, which provides an aqueous photographic processing solution used as a photographic developer bath and as a replenisher therefor, consisting essentially of, per liter of solution:

| | |
|---|---|
| A 1-phenyl-3-pyrazolidone photographic developer | 0.8 to 1.8g |
| Hydroquinone or a derivative thereof | 15 to 35g |
| Bromide ion | 0 to 4g |
| Organic anti-foggant and film speed restrainer | 7 to 26 mmol |
| Alkaline material and buffer to provide a pH at 25° C of 10.0 + 0.8 − 0.5. | |

The photographic processing solution of the invention is used without a starter solution, and furnishes both the developer bath and the replenisher therefor. Preferably, the solution contains no bromide ions, but up to about 4 grams per liter can be tolerated without ill effects. Surprisingly, although the developer bath of the invention is initially free, or essentially free, of bromide ions, the photographic developing properties are excellent from the start, and remain constant during use. As needed, the same processing solution used as the developer bath is added to the bath as the replenisher, at a given rate per unit area of film processed. During equilibration of the developer bath in an automatic processor unit, with necessary replenishment, the developer pH, concentrations of the developing agents and other consumables will all drift to lower levels; meanwhile there will be a bromide build-up. However, the developer/replenisher is chemically balanced in such a way that the changes in the developer which cause a loss of developer activity (such as lower pH, reduction in developing agents and bromide build-up) are offset by the reduction in the level of the organic anti-foggant and film speed restrainer. The net result is a developer bath that retains a nearly constant activity from the fresh state to the equilibrated state. This more nearly constant developer activity is reflected in the more nearly uniform sensitometric characteristics of the processed films throughout equilibration and continuing beyond that point in the life of the developer bath.

The advantages of the developer/replenisher system of the present invention include the following:

1. No starter solution is required to make a developer bath from a developer concentrate.

2. Over-replenishment is not a problem. If the developer is over-replenished, the developer bath would tend to return to its fresh state, which would cause little or no photographic change in the processed films.

3. A more stable replenisher is obtained. By lowering the replenisher pH to about 10.00, the shelf-life of the replenisher is increased from 2 weeks to at least about 8 weeks.

4. Less sensitometric change occurs for the processed films from fresh to an equilibrated state of the developer bath.

As the photographic developers in the processing solution, a combination of 1-phenyl-3-pyrazolidone and derivatives thereof and hydroquinone and derivates thereof is used. This combination is particularly suited for automatic processing of X-ray films.

Any alkaline material may be used to provide the required pH, such as sodium or potassium hydroxide, sodium or potassium carbonate, etc. The buffer system may be any convenient system, and the borate and carbonate buffers used in X-ray developer baths are both suitable.

The organic anti-foggant may be any organic antifoggant and film speed restrainer. Such organic anti-foggants are commonly employed in X-ray developer baths and include compounds of the benzimidazole, benzotriazole, benzothiazole, tetrazole, and thiazole series, as well as anthraquinone sulfonic acid salts. Two or more organic anti-foggants may be used.

These essential ingredients, when dissolved in water at the concentrations set forth above enable the photographic solution of the invention to function as a developer bath and a shelf-stable replenisher. While it is preferred that no bromide ions be present, up to 4 grams per liter can be tolerated, as mentioned above.

Other materials may be included in the processing solution, such as gelatin hardening agents, aerial oxidation restrainers, sequestering agents, surfactants, dyes, etc., as is well known in the art. See, e.g. U.S. Patent 3,545,971 and "Photographic Processing Chemistry", L.F.A . Mason, Focal Press, 1966, page 149 et seq.

The processing solution of the invention is prepared by dissolving the ingredients in water and adjusting the pH to 10.0 $^{+0.8}_{-0.5}$ (at 25° C). The solution is charged to the processing tank, e.g. of the type described in U.S. Pat. No. 3,545,971, such as an "X-Omat Processor", in the amount required by the system. Development time is determined empirically or by the Processor. Replenishment will be carried out at a rate per unit area of exposed film to provide processing of a large quantity of exposed film without change in sensitometric properties of the film, and will be determined empirically, as is known. As a guide, when using an X-Omat Processor to process X-ray film, a suitable replenishment rate will be about 55 ml per 240 square inches of exposed film for development to normal radiographic density using the processing solution of the invention.

After development in the processing solution of the invention, the silver halide material is fixed, preferably in an acid fixer, and washed and dried in the usual manner. If a processing machine is used, these steps will be determined by the machine.

The present invention is illustrated by the accompanying drawing, which compares the film speed as a function of the number of X-ray sheets processed with the processing solution of the present invention and with the prior art.

The present invention is also illustrated by the following Example. All parts and proportions as referred to herein and in the appended claims are by weight unless otherwise indicated.

EXAMPLE

A prior art X-ray developer was prepared, as described below, as a kit comprising a starter solution and a developer concentrate consisting of three parts. For comparison, a processing solution of the present invention was also prepared, as described below, as a kit comprising a three-part developer concentrate; no starter solution was used.

| | Quantity used, per liter | |
|---|---|---|
| | Prior Art | Invention |
| Part A | | |
| Water (deionized or demineralized) | 700.0 ml | 700.0 ml |
| Potassium carbonate | 56.0 g | — |
| Potassium hydroxide, Tech flakes | 151.0 g | 230.5 g |
| Potassium metabisulfite | 155.0 g | 168.0 g |
| Sodium sulfite | 20.0 g | — |
| Hydroquinone | 120.0 g | 100.0 g |
| Perma Kleer SP* | 14.0 g | 14.0 g |
| Boric acid | — | 80.0 g |
| Gafanol E-200* (20% solution) | 4.0 ml | 4.0 ml |
| Water (deionized or demineralized) to make | 1.0 liter | 1.0 liter |
| pH at 25C | 11.50 ± 0.05 | 11.90 ± 0.05 |
| Part B | | |
| Glacial acetic acid | 400.0 ml | 590.0 ml |
| Phenidone A | 60.0 g | 52.0 g |
| Triethylene glycol | 400.0 ml | — |
| 5-chlorobenzotriazole | 3.6 g | 3.6 g |
| 5-nitrobenzimidazole | 5.0 g | 5.0 g |
| Water (deionized or demineralized) to make | 1.0 liter | 1.0 liter |
| pH at 25C | 2.35 ± 0.05 | 1.73 ± 0.05 |
| Part C | | |
| Water (deionized or demineralized) | — | 100.0 ml |
| Glutaraldehyde - 25% solution | 830.0 ml | 800.0 ml |
| Sodium bisulfite | 80.0 g | — |
| Potassium metabisulfite | — | 240.0 g |
| Glacial acetic acid | — | 17.0 ml |
| Water (deionized or demineralized) to make | 1.0 liter | 1.0 liter |
| pH at 25C | 3.75 ± 0.75 | 2.62 ± 0.05 |
| Starter Solution | | |
| Water (deionized or demineralized) | 560.0 ml | |
| Sodium bromide | 320.0 g | |
| Glacial acetic acid | 240.0 ml | |
| Water (deionized or demineralized) to make | 1.0 liter | |
| pH at 25C | 1.5 ± 0.05 | |

16 *Perma Kleer SP - mixture of trisodium salt of ethylenediamine-tetraacetic acid and sodium glutonate (sequestering agent)
*Gafanol E-200 - polyoxyethylene glycol A processing solution according to the invention was prepared by diluting 250 ml of Part A to 750 ml with water, followed by adding, with stirring, 25 ml each of Parts B and C. The resulting solution was brought to 1 liter with water, and is ready for use both as developer bath and the replenisher therefor.

A replenisher according to the prior art was prepared by diluting 250 ml of Part A to 750 ml with water, followed by adding, with stirring, 25 ml each of Parts B and C. The resulting solution was brought to 1 liter with water. The developer bath according to the prior art was prepared by adding 25 ml of Starter Solution to 975 ml of replenisher.

The processing solution according to the present invention, prepared as above, had a pH (25° C) of 10.02 ± 0.05, the prior art developer had a pH (25° C) of 10.00 ± 0.05 and the prior art replenisher had a pH (25° C) of 10.40 ± 0.05.

A hospital processing exposed GAF Medical X-ray film, HR2000 and HR3000, with the prior art developer described above using an M-4 X-Omat Processor, an M-6 AN X-Omat Processor and a Profexray Processor changed over to the processing solution of the invention. The sensitometric properties of the developed film and the physical performance of the processing machines were judged to be equally satisfactory by the hospital personnel when using the prior art developer/-replenisher/starter solution and the processing solution of the invention. The processing solution of the invention was prepared as described above from Parts A, B and C and used as both the developer and the replenisher. As developer, the processing solution was charged to the developing tank and used at the same developing temperature previously used. As replenisher, the processing solution was used at a rate of 55 ml per 240 square inches of exposed X-ray film processed.

However, two important differences were noted. First, the replenisher prepared according to the prior art had a shelflife of only two weeks, whereas the processing solution of the invention, which was used as the developer and replenisher was stored for 8 weeks without adverse effects. Second, when X-ray film is processed using the processing solution of the present invention, more uniform sensitometric properties are obtained.

This can be seen from the data in the accompanying drawing. These data were obtained as a composite of the results of the processing of GAF Medical X-ray film, HR3000, using the prior art developer/replenisher/starter solution and the developer/replenisher of the present invention in the three X-ray processors as described above. A value of 100% was assigned to the maximum film speed of the X-ray film processed by the prior art system, and all other film speeds were calculated relative to that. Using the prior art system, the film speed gradually increases from 80% to 100%, whereas with the developer/ replenisher system of the invention, the film speed rises from about 85% to about 93% and then gradually returns to 85%, and hence a more nearly constant sensitometry is obtained with the present invention.

What is claimed is:

1. An aqueous photographic processing solution useful as a photographic developer bath for automatic processing of X-ray film and as a replenisher therefor, consisting essentially of, per liter:

| | |
|---|---|
| A 1-phenyl-3-pyrazolidone photographic developer | 0.8 to 1.8g |
| Hydroquinone or a derivative thereof | 15 to 35g |
| Bromide ion | 0 to 4g |
| Organic anti-foggant and film speed restrainer | 7 to 26 mmol |
| Alkaline material and buffer to provide a pH at 25° C of 10.0 + 0.8 − 0.5. | |

2. The processing solution according to claim 1, which contains no bromide ion.

3. The processing solution according to claim 1, wherein the organic anti-foggant is one or more members selected from the group consisting of a benzimidazole, a benzotriazole, a tetrazole, a thiazole and an anthraquinone sulfonic acid salt.

4. The processing solution according to claim 1, which contains one or more adjuvants selected from the group consisting of gelatin hardening agents, aerial oxidation restrainers, sequestering agents, surfactants and dyes.

5. The automatic processing of exposed photographic silver halide X-ray film, wherein the imagewise exposed X-ray film is developed in a photographic developer bath comprising a photographic developer, an alkaline material and a buffer system to maintain the pH of the developer bath at a desired value, an organic anti-foggant and water, the developed X-ray film is fixed, washed and dried, and the developer bath is replenished by a replenisher solution to maintain constant the photographic properites of the developer bath during processing of a large quantity of exposed X-ray film, the improvement which comprises using a processing solution as both the developer bath and the replenisher solution consisting essentially of, per liter:

| | |
|---|---|
| A 1-phenyl-3-pyrazolidone photographic developer | 0.8 to 1.8 g |
| Hydroquinone or a derivative thereof | 15 to 36g |
| Bromide ion | 0 to 4g |
| Organic anti-foggant and film speed restrainer | 7 to 26 mmols |
| Alkaline material and buffer to provide a pH at 25°C of 10.0 + 0.8 − 0.5. | |

| | |
|---|---|
| A 1-phenyl-3-pyrazolidone photographic developer | 0.8 to 1.8g |
| Hydroquinone or a derivative thereof | 15 to 35g |
| Bromide ion | 0 to 4g |
| Organic anti-foggant and film speed restrainer | 7 to 26 mmol |
| Alkaline material and buffer to provide a pH at 25° C of 10.0 + 0.8 − 0.5. | |

6. The process according to claim 5, wherein the processing solution contains no bromide ion.

7. The process according to claim 5, wherein the organic anti-foggant is one or more members selected from the group consisting of a benzimidazole, a benzotriazole, a tetrazole, a thiazole and an anthraquinone sulfonic acid salt.

8. The process according to claim 5, wherein the processing solution contains one or more adjuvants selected from the group consisting of gelatin hardening agents, aerial oxidation restrainers, sequestering agents, surfactants and dyes.

* * * * *